US006286697B1

(12) United States Patent
Gasparini

(10) Patent No.: US 6,286,697 B1
(45) Date of Patent: Sep. 11, 2001

(54) NURSING TEAT AND TEAT AND BOTTLE ASSEMBLY

(75) Inventor: Giacomo Salvatore Gasparini, East Kew (AU)

(73) Assignee: Jott Australia Pty. Ltd., Hawthorn (AU)

( * ) Notice: Subject to any disclaimer, the term of this patent is extended or adjusted under 35 U.S.C. 154(b) by 0 days.

(21) Appl. No.: 09/000,114

(22) PCT Filed: Jul. 24, 1996

(86) PCT No.: PCT/AU96/00462

§ 371 Date: May 8, 1998

§ 102(e) Date: May 8, 1998

(87) PCT Pub. No.: WO97/04735

PCT Pub. Date: Feb. 13, 1997

(30) Foreign Application Priority Data

Jul. 25, 1995 (AU) ..... PN4395

(51) Int. Cl.[7] ..... A61J 11/02

(52) U.S. Cl. ..... 215/11.5; 215/11.1

(58) Field of Search ..... 215/11.1, 11.5, 215/11.6

(56) References Cited

U.S. PATENT DOCUMENTS

| | | |
|---|---|---|
| 1,998,646 | 4/1935 | Yager . |
| 2,736,446 | 2/1956 | Raiche . |
| 3,115,980 | 12/1963 | De Woskin . |
| 3,200,980 | 8/1965 | Jamell . |
| 3,292,809 | 12/1966 | Shomock et al. . |
| 3,358,864 | 12/1967 | Meierhoefer . |
| 3,393,817 | 7/1968 | Meierhoefer . |
| 3,493,139 | 2/1970 | Faddoul et al. . |
| 3,545,637 | 12/1970 | Barr . |
| 3,768,683 | 10/1973 | Van Den Bosch . |
| 4,311,245 | 1/1982 | Maffei . |
| 4,401,224 | 8/1983 | Alonso . |
| 4,613,050 | 9/1986 | Atkin et al. . |
| 4,828,126 | 5/1989 | Vincinguerra . |
| 4,928,836 | 5/1990 | Wu et al. . |
| 5,150,800 | 9/1992 | Sarter et al. . |
| 5,419,445 | 5/1995 | Kaesemeyer . |

FOREIGN PATENT DOCUMENTS

| | | | | |
|---|---|---|---|---|
| 420983 | | 8/1968 | (AU) . | |
| 54485/80 | | 7/1980 | (AU) . | |
| 89979/82 | | 5/1983 | (AU) . | |
| 29971/84 | | 8/1985 | (AU) . | |
| 576769 | | 9/1988 | (AU) . | |
| 69242/91 | | 7/1991 | (AU) . | |
| 46276/93 | | 3/1994 | (AU) . | |
| 63234/94 | | 7/1994 | (AU) . | |
| 527094 | * | 2/1993 | (EP) | 215/11.1 |
| 0587505 | | 3/1994 | (EP) . | |
| 587505 | * | 3/1994 | (EP) | 215/11.5 |
| 324194 | * | 1/1930 | (GB) | 215/11.1 |
| 987907 | | 3/1965 | (GB) . | |
| 1432798 | | 4/1976 | (GB) . | |
| 2154451 | * | 9/1985 | (GB) | 215/11.5 |
| 90/07320 | | 7/1990 | (WO) . | |

* cited by examiner

*Primary Examiner*—Sue A. Weaver
(74) *Attorney, Agent, or Firm*—Stroock & Stroock & Lavan LLP

(57) ABSTRACT

An assembly may comprise a nursing bottle, a teat, the teat having a flange with a sealing surface, and a retaining cap for releasably retaining the teat to the bottle. The retaining cap may move in a direction to act on the flange to press the sealing surface of the flange into sealing engagement with a wall of the nursing bottle in a direction substantially parallel to the direction of movement of the retaining cap, to form a flap valve. The flange of the teat may have a resilient skirt dependent therefrom which provides the sealing surface of the flap valve.

16 Claims, 8 Drawing Sheets

NURSING TEAT AND TEAT AND BOTTLE ASSEMBLY

FIELD OF INVENTION

The present invention relates to a re-useable nursing bottle and teat assembly for feeding infants which suckle, including humans and animals. More particularly the invention relates to a nursing teat and teat and bottle assembly in which the flow of contents from the bottle is responsive to the demands of the infant and which, preferably, can be easily adjusted to any preset level to suit any infant.

DESCRIPTION OF THE PRIOR ART

Often, in nursing bottle and teat assemblies of this type, the liquid withdrawn from the bottle by an infant sucking is not replaced by air at a rate which correlates to the rate demanded by the infant. The demand will vary from infant to infant and for any one infant may also vary from one feed to the next or from time to time during a single feed. Such a mis-match between the rate of outflow of liquid and inflow of air can produce a large variation in the vacuum produced in the bottle. At one extreme, the infant will need to release the teat to allow air to enter the bottle through the exit hole or holes of the teat before the infant can withdraw more liquid. At the other extreme, during a pause in feeding by the infant, liquid outflow from the bottle may occur solely due to the force of gravity, which can lead to a possible choking effect when the infant receives liquid unexpectedly when suckling is temporarily stopped.

One method proposed to ameliorate these problems is by the use of ribs or grooves on the underside of the flange on the teat or on the rim of the bottle neck, which enable air which has passed around the threads on the bottle neck to pass into the bottle interior through the passages thus formed between the teat and the mouth of the bottle. In these bottles, limited adjustment of the rate of inflow of air into the bottle is possible by tightening or untightening the cap so as to deform the resilient flange and to thereby alter the aperture of the air passages.

These bottles, however, still suffer a number of disadvantages. If the bottle is inverted or shaken during use, the contents of the bottle can leak out through the air passages. Further, shaking the bottle can also lead to the narrow passages becoming blocked, resulting in teat collapse. In addition, the narrow range of adjustment of the aperture size of the air passages may not be sufficient to accommodate the rate of feed demanded by the infant.

These problems have also been addressed in a bottle and teat assembly in which a valve, and more particularly, a flap valve, is used in combination with one or more air passages. The flap valve, which is normally closed to prevent leakage through the air passages, is formed by a resilient, annular skirt depending from the lower face of the flange. The diameter of the annulus formed by the edge of the resilient skirt is less than the internal diameter of the bottle neck so as to enable it to be inserted into the neck. When the cap is screwed into place, the cap acts on the flange which in turn causes the resilient skirt to deform outwardly in a radial direction so as to engage and seal against the vertical inner side wall of the bottle. The flap valve is opened by deforming inwardly away from the inner side wall of the bottle as the pressure in the bottle is reduced by an infant sucking the teat. However in this prior art arrangement the positioning of the flap valve against the inner wall of the bottle requires that one or more air passages be provided between the flange of the teat and the rim of the bottle mouth. As in the valveless prior art arrangements, the air passages are formed by ribs or grooves on the lower face of the flange or on the rim of the bottle neck. Once the cap is screwed into place, the flange of the teat is forced against the rim of the bottle mouth and the ribs or grooves on the lower face of the flange or on the rim of the bottle neck act to provide air passages.

In addition, it has also been suggested that a means for regulating the rate of air flowing into a bottle in which a flap valve arrangement is utilised may be by tightening or untightening the cap so as to vary the force applied and thus adjust the aperture of the air passages.

In each of these prior art flap valves, the flap valve seals against the bottle under an indirect force exerted by the cap on the valve. In particular, as the cap is screwed on the bottle, an axial force is exerted by the cap on the flange of the teat so as to stretch an annular area of the flange which has a radius which is smaller than the radius of the bottle mouth, thereby resulting in a turning moment being generated in the annular skirt. This causes the skirt to deform outwardly in a radial direction; that is, at right angles to the axial tightening force, and to seal against the vertical inner side wall of the bottle.

The conversion of an axial force applied to the teat flange by screwing the cap onto the bottle into an indirect radial force which is required in order for the skirt to contact the wall at all points is difficult to control. As a result, the valve may not seal reliably, and the pressure at which the valve opens is difficult, if at all possible, to accurately regulate. In addition, the rotary motion of the cap can cause the teat to twist as the cap is fastened, which tends to buckle the skirt and to prevent the flap valve from forming an effective seal.

Furthermore, and importantly, in nursing bottle and teat assemblies with the flap valves used in conjunction with air passages, it is the air passages rather than the flap valve which regulate the maximum rate of airflow into the bottle.

The present invention therefore seeks to overcome or reduce some or all of the disadvantages outlined above by providing an improved flap valve arrangement in a teat and bottle assembly, or a teat for use in the assembly.

One object of the present invention is to provide nursing bottle and teat assembly utilizing a flap valve which seals reliably in the absence of an infant sucking on the teat.

Another object of the invention is to provide a nursing bottle and teat assembly utilizing a flap valve wherein the minimum vacuum pressure at which the flap valve opens can be varied so as to accord with the demands of any infant.

BRIEF DISCLOSURE OF THE INVENTION

It has been surprisingly found that the control of the flow of air into a nursing bottle, and thus control of the flow of liquid from the bottle, can be enhanced by using a teat having a flange forming a flap valve with a wall or mouth of the bottle wherein the sealing surface of the flap valve is adapted to be directly forced against the wall or the mouth of the nursing bottle.

Preferably the flange of the teat has a resilient skirt dependent therefrom which provides the sealing surface of the flap valve.

Preferably the teat is retained on the bottle by a retaining cap, said retaining cap applying a force to the teat which directly presses the sealing surface of the flap valve against the wall or the mouth of a nursing bottle. That is, the force pressing the sealing surface of the flap valve against the wall or mouth of the nursing bottle is in substantially the same direction as the force applied by the retaining cap to the teat.

Preferably there is an axial force between the sealing surface of the flap valve and the wall or the mouth of the nursing bottle; that is, a force in the direction of the principal axis of the bottle.

The present invention also provides, in one preferred form, a teat having a flange forming a flap valve wherein the sealing surface of the flap valve can be progressively and directly forced against the wall or mouth of the nursing bottle. In this form the invention provides a degree of control or regulation over the vacuum pressure required to open the flap valve. This ability to regulate the vacuum required to open the flap valve allows infants of differing physical developments to feed in comfort.

The flange of the teat, being integral with and of the same material as the teat, is able to flex under force to enable a variable force to be applied between the sealing surface of the flap valve and the sealing surface of the wall or mouth of the bottle. Preferably the flange of the teat has a resilient skirt dependent therefrom which provides the sealing surface of the flap valve.

Alternatively the present invention provides a teat having a flange forming a flap valve wherein the sealing surface of the flap valve is adapted to be directly forced against the wall or mouth of the nursing bottle; the stiffness of the flap valve being predetermined in accordance with the physical development of an infant so as to determine the vacuum pressure required to open the flap valve.

The present invention also provides, in another preferred form, a teat and bottle combination, said teat and bottle combination including a cap for retaining the teat on the bottle, said teat having a flange forming a flap valve with a wall or mouth of the bottle wherein the sealing surface of the flap valve is directly pressed against the wall or mouth of the nursing bottle by direct force applied by the retaining cap.

The present invention further provides a nursing teat adapted for attachment to a nursing bottle, said bottle having a mouth with a rim and having a shoulder which is inclined relative to the wall of the bottle, said attachment of said teat to said bottle being by means of an annular cap, said teat including an annular flange and a flap valve which comprises an annular skirt depending from the lower face of the flange in which:

(i) the annular cap is adapted to be connected to the bottle to fasten the teat in position by holding the flange of the teat between the annular cap and the rim of the mouth of the bottle and to provide a variable degree of force and to provide a liquid seal between the cap and the bottle and in which the variable degree of force results in an axially variable force applied to the skirt;

(ii) the flap valve forms a variable pressure seal against the wall or mouth of the bottle by the axially variable force applied to the skirt by the cap against the shoulder of the bottle such that, in use, reduced pressure in the bottle as a result of the suckling of the nursing infant causes the flap valve to open at variable pressures by forcing the skirt away from the shoulder of the bottle to permit the flow of a liquid from the bottle.

The present invention therefore additionally provides a nursing bottle and teat combination including (i) a bottle, (ii) a teat with an annular flange, (iii) an annular cap which is connected to the bottle to fasten the teat in position by holding the flange between the rim of the bottle mouth and the cap, (iv) a flap valve comprising an annular skirt depending from the lower face of the flange with an annular flat surface thereon, and (v) a shoulder on the bottle which is inclined relative to the side wall of the bottle, and wherein (a) the flap valve normally forms a seal against the shoulder or mouth of the bottle by the direct, adjustable axial force applied to the skirt by the cap; (b) reduced pressure in the bottle as a result of suckling of the nursing infant causes the flap valve to open by resiliently deforming the skirt away from the shoulder or mouth; and (c) the axial force applied to the skirt by the cap is adjustable thus varying the pressure at which the flap valve opens.

Preferably the shoulder on the bottle is a surface which is external or internal to the bottle. The shoulder may be perpendicular to the sides of the bottle but is preferably inclined at an angle to the side wall of the bottle.

Preferably the skirt on the annular flange is shaped to suit contact with the shoulder or mouth when the valve is closed.

Preferably the skirt is adapted to provide a large contact area with the sealing surface of the wall or mouth of the bottle thereby improving the sealing characteristics and regulation of the vacuum pressure required to open the valve.

Preferably the retaining cap used to hold the teat in place on the bottle has a perforated annular end to go over the teat, and a generally cylindrical skirt dependent from the lower face of the end.

Any suitable means may be used to couple the cap to the bottle, including a bayonet or screw threaded coupling. The bayonet coupling is particularly preferred if the means of adjusting the required vacuum pressure to open the flap valve is to be by varying the axial force applied to the skirt. Typically, the bayonet coupling has a number of fastening pins, each of which slides in a groove having an upper wall which inclines towards the bottom of the bottle so as to increase the force on the teat skirt as the cap is tightened. The fastening pins may be located on the inside surface of the skirt of the cap and the corresponding groove or grooves located on the outer surface of the side wall of the bottle, or vice versa. A "tamper-proof" feature of the bayonet coupling may be provided, in the form of a stopper at the upper end of each groove, so that at the end of the travel of the cap as it is unscrewed the cap requires an extra downwards (i.e. towards the bottle) force to enable it to be removed for cleaning or filling. This prevents accidental removal of the cap, with resultant spillage.

In addition, the bottle assembly may include indicating means, such as co-operating projections and indentations on the inside surface of cap skirt and outer surface of bottle, to facilitate adjustment of the pressure at which the flap valve opens to suit the particular infant's needs.

Preferably an annular slip ring is located between the lower face of the cap and the upper face of the flange on the teat to prevent the flange and/or skirt from buckling as the cap is tightened or untightened and thereby reducing the effectiveness of the flap valve. The slip ring may be made from, or coated with, any low friction material. Preferably a low friction plastics, such as teflon, is used.

The bottle and teat assembly preferably includes a cover to protect the teat when not in use and to avoid the necessity of inverting the teat from a carrying or non-use position with the teat projecting into the bottle to an in-use position where the teat projects ready for use. In the present invention the teat is preferably always carried in the in-use position and is protected by a cover which helps to keep the teat clean and helps to prevent leakage from the teat and bottle assembly during transport when containing liquid. The cover preferably fits snugly over the teat and includes in its upper end a dimple or projection which, when fitted, presses against the top of the teat and seal the teat holes to prevent or reduce leakage of liquid. The teat cover also preferably includes a flange which, when the cover is fitted, presses on a secondary flange of the teat, securely holding it between the cover and the cap, thereby forming a secondary seal to contain any liquid that may have leaked through the teat holes.

In addition, in order to still further reduce the risk of leakage during bottle transport, the teat cover is preferably coupled to the bottle by a "tamper-proof" and tight-fit coupling. In a preferred form of coupling between the teat cover and the bottle, a novel design of closure system is provided wherein the teat cover and the teat retaining cap or bottle are adapted to be fitted together with a snap fit action and to be separated by a turn and pull action. Alternatively the teat cover may be coupled to the bottle by a conventional snap fit arrangement or by a screw or bayonet coupling.

DETAILED DESCRIPTION OF PREFERRED EMBODIMENTS

A number of preferred embodiments of the invention will now be described with reference to the accompanying drawings, in which.

Figure 7:
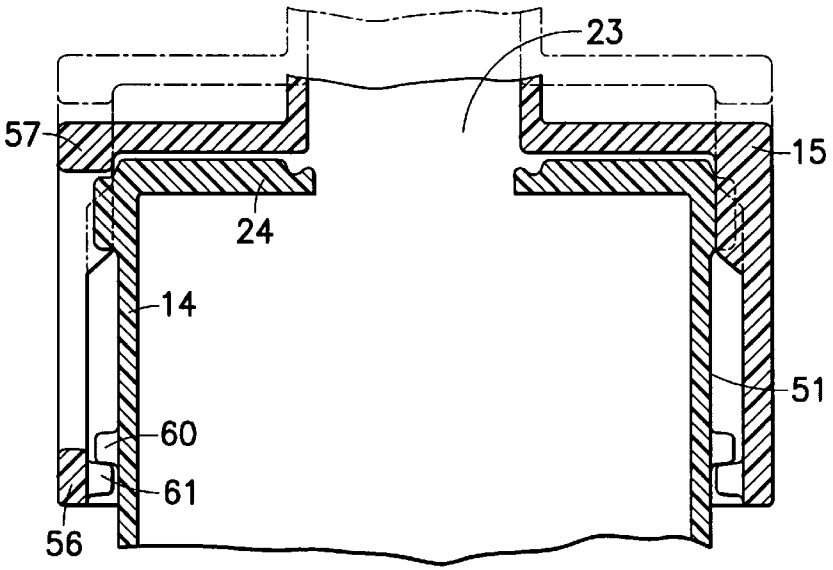
FIG. 7 is a schematic vertical cross section of part of a teat cover and teat retaining cap (teat and nursing bottle not shown) illustrating a preferred fastening arrangement between the teat cover and the teat retaining cap.
Figure 10C:
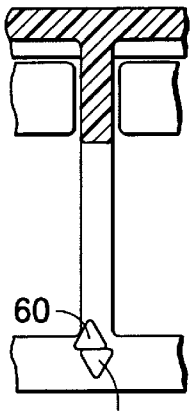
Figure 10B:
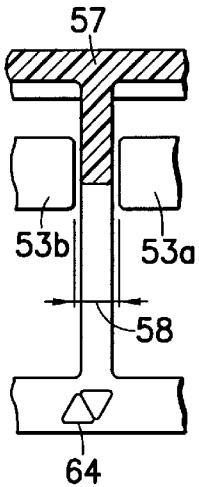
Figure 10A:
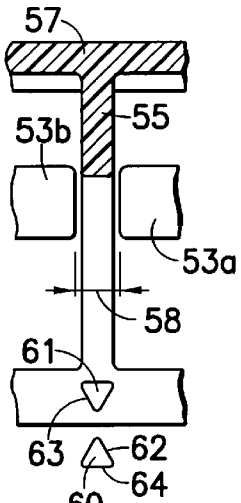

FIGS. 10*a*, 10*b*, 10*c* are sectional views along line "B" in FIG. 7 and illustrate the fastening mechanism between the teat cover and the teat retaining cap during successive stages of the teat cover being fastened to the teat retaining cap.

The nursing bottle assemblies shown in FIGS. 1 to 6 generally comprise bottle 10, teat 12, slip ring 13, retaining cap 14 and teat cover 15.

Figure 1:
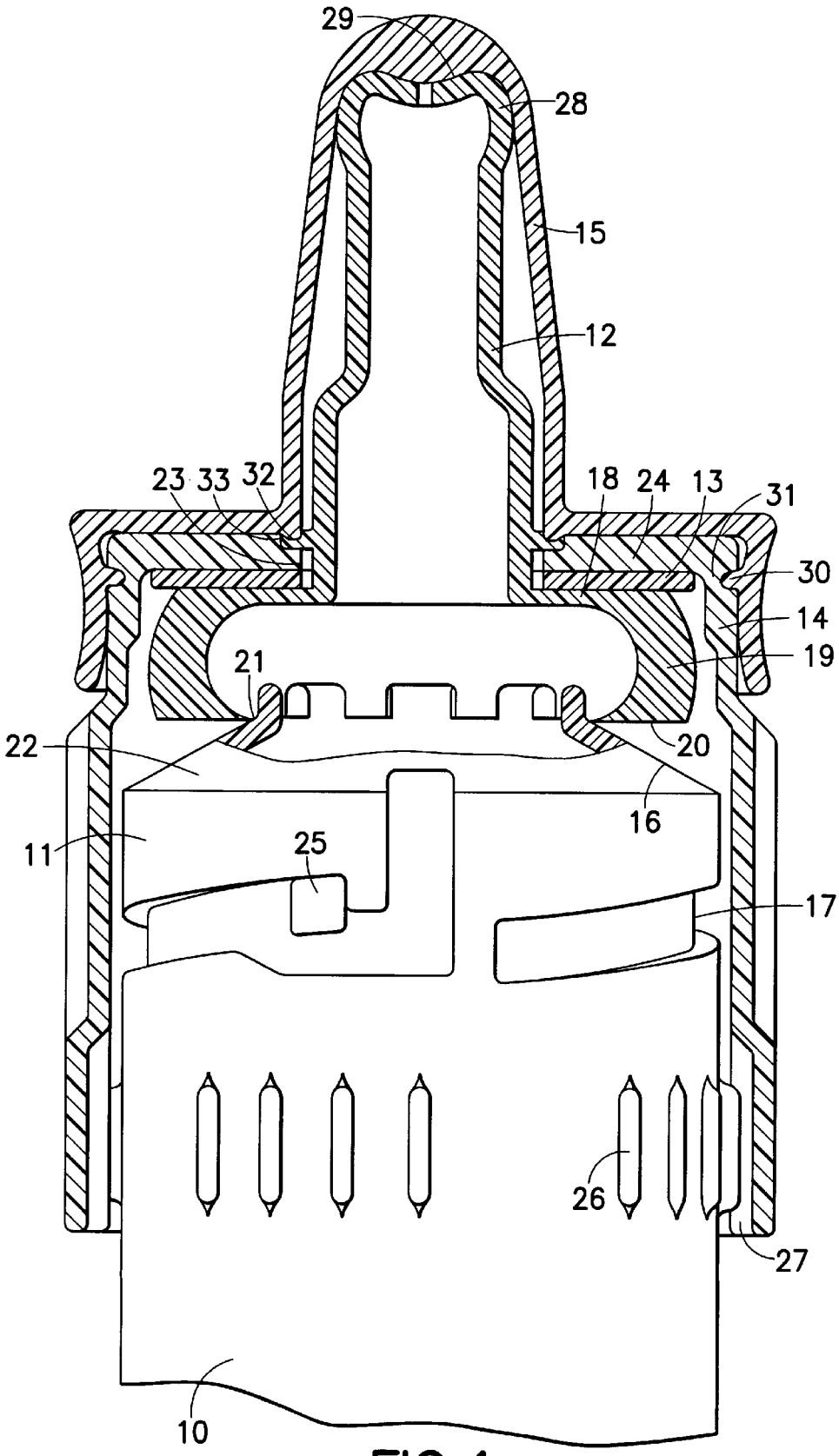
FIG. 1 is a schematic vertical cross section of the top portion of an assembled nursing bottle assembly in accordance with a first preferred embodiment of the present invention, showing the flap valve in an operative position against an upper external shoulder on the bottle.
Figure 2:
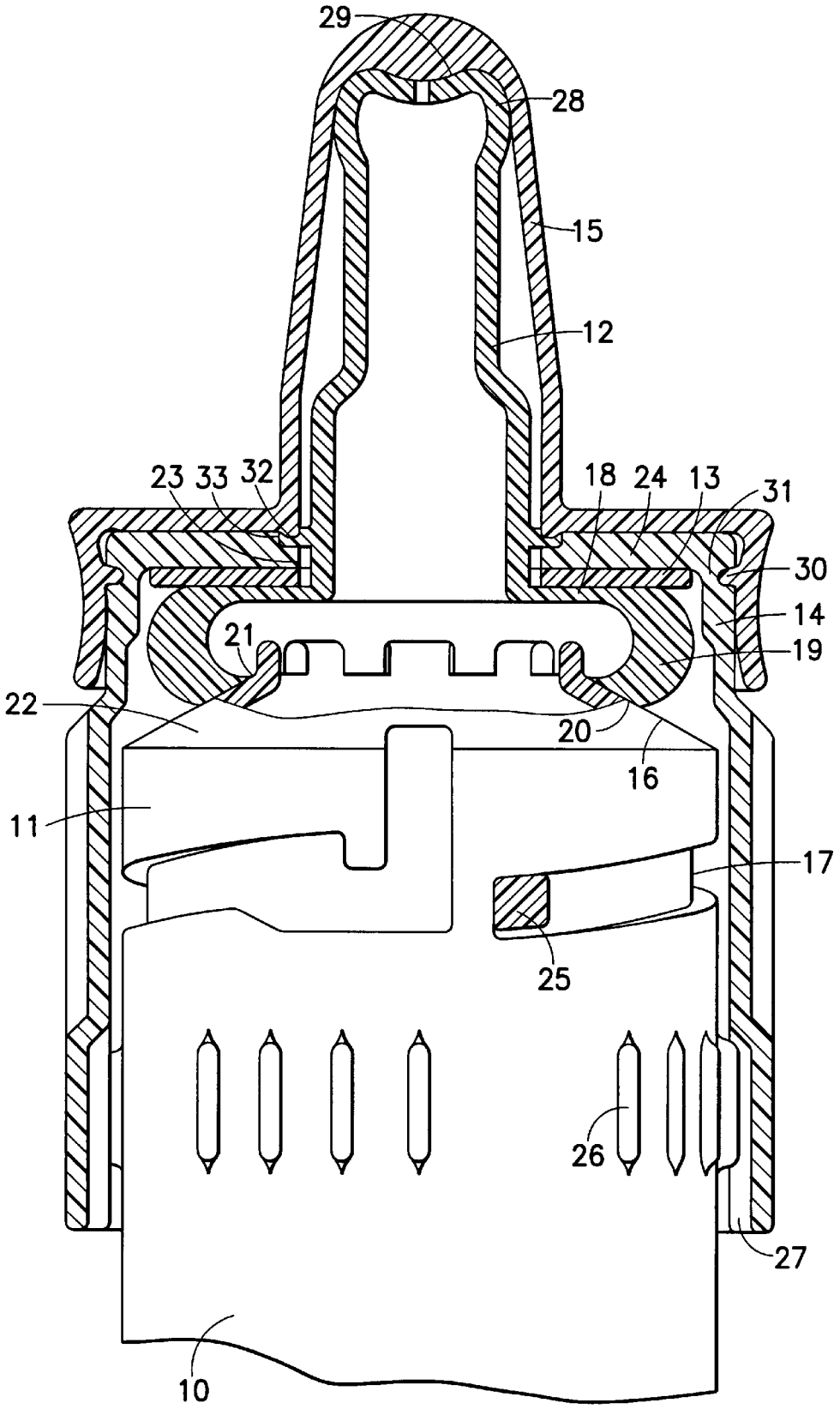
FIG. 2 is a schematic vertical cross section of the top portion of an assembled nursing bottle assembly in accordance with a first preferred embodiment of the present invention, showing the flap valve in a substantially completely closed and substantially inoperative position against an upper external shoulder on the bottle.

In the embodiment illustrated in FIGS. 1 and 2, the upper end 11 of the bottle 10 (part shown) has an annular shoulder 16 which is inclined relative to the cylindrical wall of the bottle 10. The teat 12 has a lower annular flange 18. An annular skirt 19 depends from the lower face of the flange 18. The lower end of the skirt tapers to form a flat annular face 20. When the assembly is assembled as shown in FIG. 1, the skirt 19 abuts the shoulder 16 near the mouth 22 of the bottle 10 and the edge 21 of the skirt 19 engages the shoulder 16 on the bottle 10 forming a flap valve seal which is broken when an infant sucks on the teat 12 of the bottle 10 and causes the edge 21 of the skirt 19 to deform away from the shoulder permitting air to enter the bottle 10 and in consequence, permit liquid (not shown) to be drawn from the bottle 10 by an infant.

The cap 14 is generally cylindrical, has a central hole 23 in its upper-end 24 which enables the cap to pass over the teat 12 and to hold the teat in place. When the assembly is assembled, the top 24 of the cap 14 forces the skirt 19 of the flange 18 against the shoulder 16 of the bottle 10.

Opposed projections 25 are located on the inner surface of the wall of the cap 14 configured to slide in grooves 17 on the outer surface of the wall of the bottle to couple the cap to the bottle. The upper wall of each groove inclines towards the bottom of the bottle and as the cap is tightened the projections follow the slope of the groove, increasing the pressure on the face 20 of the skirt and increasing the surface area of the face 20 in contact with the shoulder 16, with the result that the flap valve requires an increased pressure to be exerted on the teat by the infant to open.

A series of cap projections 27 are formed on the inside wall of the cap and co-operate with a series of wall projections 26 around the circumference of the outside of the wall of the bottle. The opposed or interfering cap projections and wall projections are resiliently deformable, enabling the projections on the cap to push or "click" past the wall projections as the cap is tightened or untightened. The number of projections traversed as the cap is tightened provides a visual, tactile and/or audible indication of the degree of force exerted on the flap valve. Once the pressure able to be exerted by an individual infant has been determined, the nursing bottle and teat assembly can be quickly adjusted to the correct force by re-aligning the projections to the position determined as appropriate to the age or physical development or the demand (at any time) of the infant.

The bayonet fitting of the cap allows for a "tamper proof" fitting of the cap to the bottle. The adjustment of the cap to permit variation in the flow of the liquid from the bottle does not result in accidental removal of the cap (with resultant spillage). The cap requires extra downwards force (i.e. towards the bottle) to enable the cap to be removed for cleaning or filling.

The slip ring has a central hole which passes over the teat. The slip ring is of a similar diameter to the flange on the teat and provides a low friction upper surface which slides against the cap as the cap is fastened or unfastened so that the teat is not twisted by the rotary motion of the cap. The slip ring 13 may comprise a PTFE fluoropolymer, such as, for example, TEFLON®. It should be noted that, if the materials of the cap 14 and the teat 12 are such that there is very little friction between the cap and the teat when they are in direct contact, with the consequence that the teat is not twisted by the rotary motion of the cap without usiing the slip ring, then the slip ring is not required.

The teat has a mouthpiece 28 with a perforated end surface. In order to prevent leakage from these perforations when a filled nursing bottle and teat assembly is transported, the inside end face 29 of teat cover 15 is flattened or convex or includes a projection so that when the teat cover 15 is in place the mouthpiece of the teat is sealed against the inside end face of the teat cover. In the embodiments depicted in FIGS. 1 and 2 the teat cover 15 is held on the cap by means of a snap fit connection between one or more projections 30 on the inside surface of teat cover 15 and one or more cooperating indentations 31 on the outside surface of the cap. Additionally, the teat has an additional or secondary flange 33 which forms a secondary liquid seal with the seal bead 32 on the inside of the teat cover at a position overlying the secondary flange when the cover is snap fitted onto the cap of the teat and bottle assembly. In addition to forming a secondary liquid seal when the cover is in place, the secondary, flange prevents the teat from being pulled towards the bottle 10 by the vacuum developed in the bottle during feeding.

In FIG. 2, the flap valve is shown in a substantially completely closed and inoperative position, as a result of the cap being turned until the opposed projections 25 on the cap engage the end of their respective grooves 17 on the outer surface of the bottle wall. In this position there is maximum surface area of contact and maximum contact force between the flap valve and the shoulder, thus preventing any possibility of leakage of the bottle contents through the flap valve when the bottle is transported.

Figure 3:
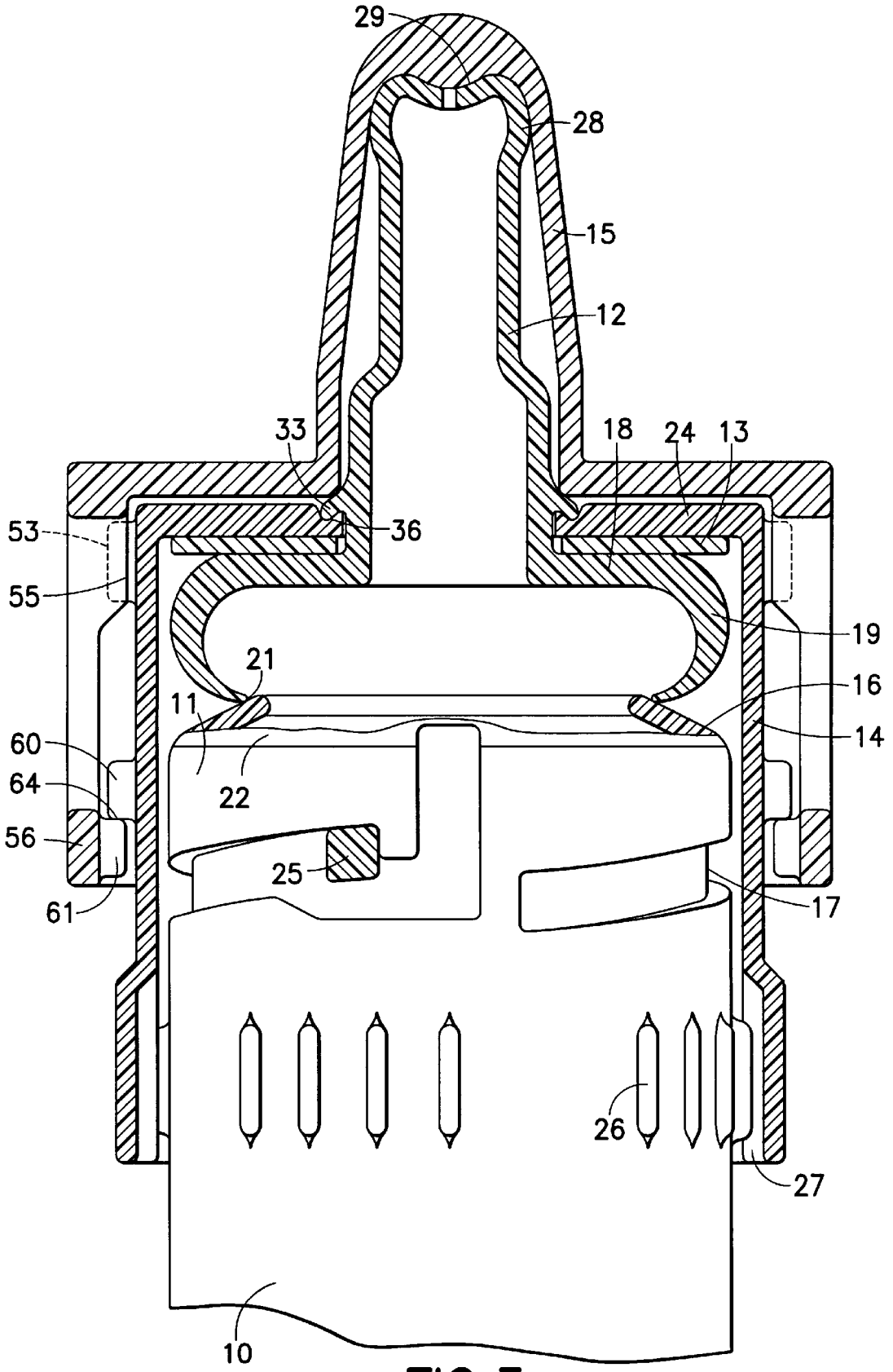
FIG. 3 is a schematic vertical cross section of the top portion of an assembled nursing bottle assembly in accordance with a second preferred embodiment of the present invention, showing the flap valve in an operative position against an alternative arrangement of an upper external shoulder on the bottle.

In the embodiment illustrated in FIG. 3, the annular skirt 19 depending from the lower face of the flange 18 tapers at its lower end to form a thin annular edge 21 which, when the assembly is assembled, abuts the outer surface of the shoulder 16 near the mouth 22 of the bottle 10 forming the flap valve seal.

In contrast to the embodiment illustrated in FIGS. 1 and 2, the secondary flange 33 on the teat fits snugly in a groove 36 in the upper end 24 of the cap when the assembly is assembled.

Figure 4:
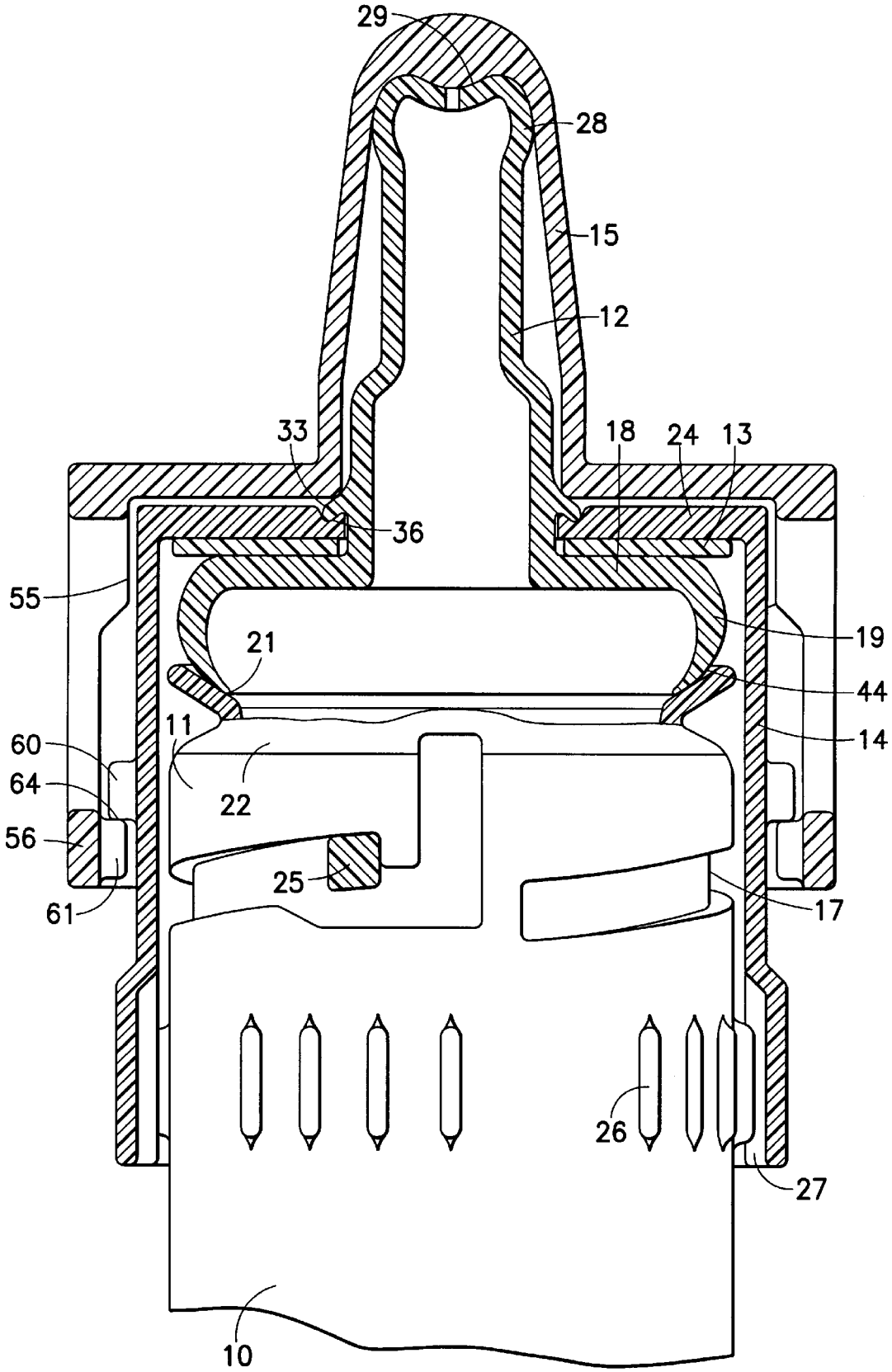
FIG. 4 is a schematic vertical cross section of the top portion of an assembled nursing bottle assembly in accordance with a third preferred embodiment of the present invention, showing the flap valve in an operative position against an upper internal shoulder on the bottle.

The nursing bottle and teat assembly depicted in FIG. 4 comprises generally similar arrangement to the bottle assembly depicted in FIG. 3. However, in this embodiment the edge 21 of the skirt 19 forms a flap valve against an inner shoulder 44 on the bottle 10.

Figure 5:
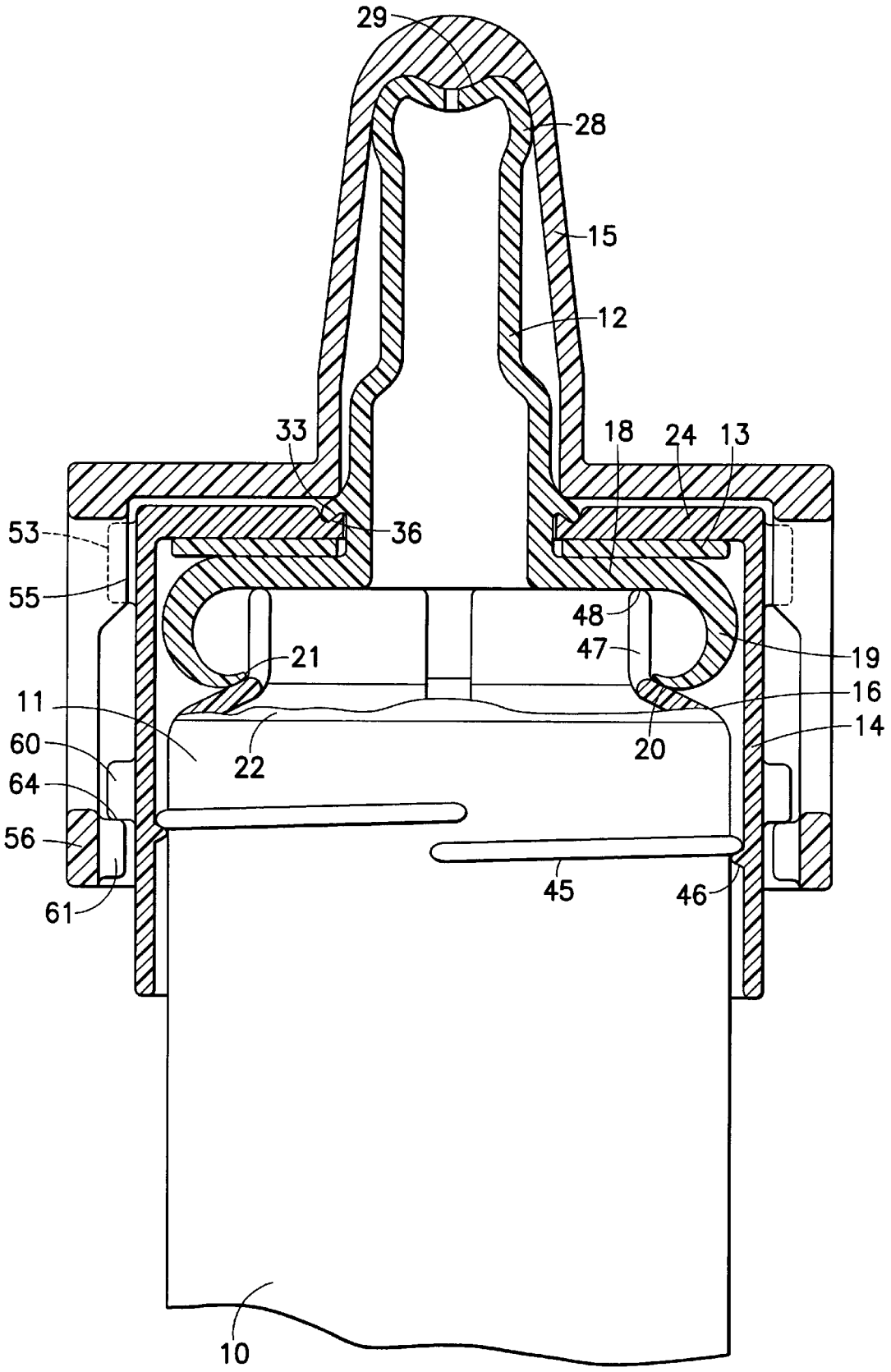
FIG. 5 is a schematic vertical cross section of the top portion of an assembled nursing bottle assembly in accordance with a fourth preferred embodiment of the present invention, showing the flap valve in a substantially completely closed and substantially inoperative position against an alternative arrangement of an upper external shoulder on the bottle.
Figure 6:
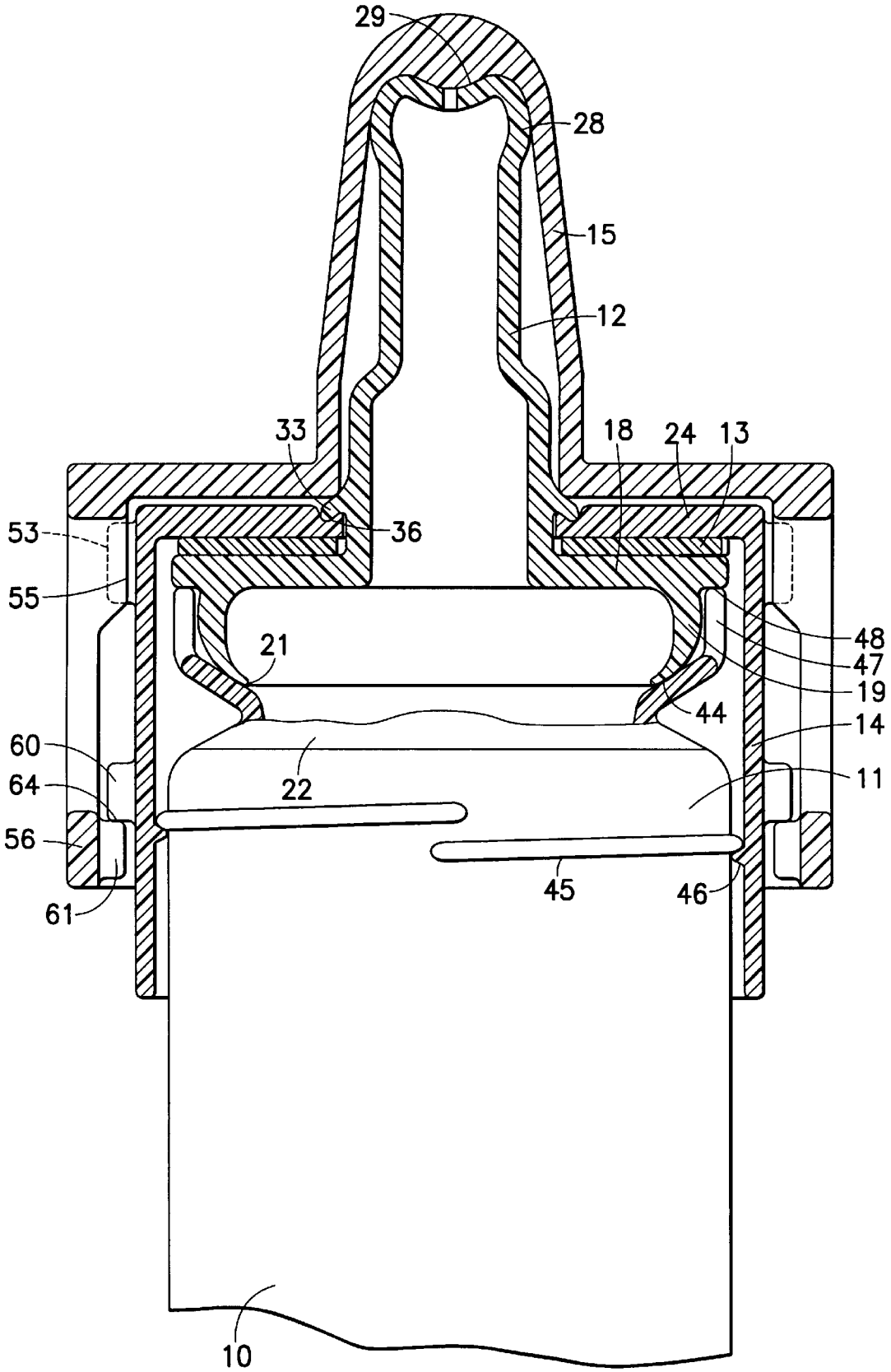
FIG. 6 is a schematic vertical cross section of the top portion of an assembled nursing bottle assembly in accordance with a fifth preferred embodiment of the present invention, showing the flap valve in a substantially completely closed and substantially inoperative position against an alternative arrangement of an upper internal shoulder on the bottle.

FIGS. 5 and 6 illustrate further embodiments of the present invention in which the cap 14 is fastened to the bottle 10 by means of opposed threads 45, 46 on the bottle and cap respectively. In both the embodiment illustrated in FIG. 5, in which the edge 21 of the skirt 19 acts on an external shoulder 16, and the embodiment illustrated in FIG. 6, in which the edge 21 of the skirt 19 acts on an inner shoulder 44, the flange 18 is supported on a perforated neck 48, which has perforations 47 in numbers and/or sizes sufficient to ensure that the flow of air through the neck is not impeded.

Whilst the embodiments depicted in FIGS. 1, 2, 3 and 4 include a threaded fastening which incorporates the projections 26, 27 in order to facilitate adjustment of the force on the flap valve to the required minimum opening pressure, it is also contemplated that the projections may be omitted and that in normal use the cap is always fully tightened, as illustrated in the embodiments depicted in FIGS. 6 and 7. In use, the flange 18 illustrated in each of FIGS. 5 and 6 remains in a fixed position relative to the bottle 10 instead of being able to be moved towards or away from the bottle. The teat 12 therefore exerts a fixed contact pressure on the shoulder 16 of the bottle when assembled, setting the minimum opening pressure to a constant value. It a different value of contact pressure is required such as to suit the age or physical development of the infant, the teat must be replaced by another teat of similar construction but having a different stiffness in the skirt. Thus, a series of teats with different skirt stiffness can be made available to be used in the bottle assembly, and the consumer needs to buy only the teat that suits the infant at any particular stage of the infant's development.

Also illustrated in the embodiments of FIGS. 3 to 6 is an alternative arrangement for fastening the teat cover 15 to the teat retaining cap 14. The details of the preferred embodiment of this closure arrangement will now be described with reference to FIGS. 7, 8, 9, 10*a*, 10*b* and 10*c*.

Figure 8:
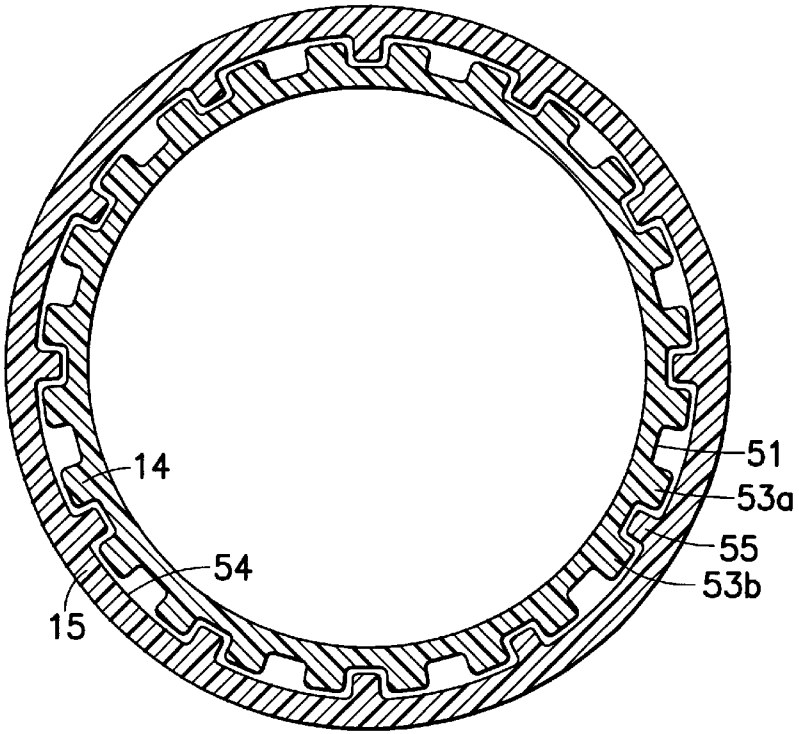
FIG. 8 is a sectional view of the teat cover and teat retaining cap taken along line "D" in FIG. 7.
Figure 9:
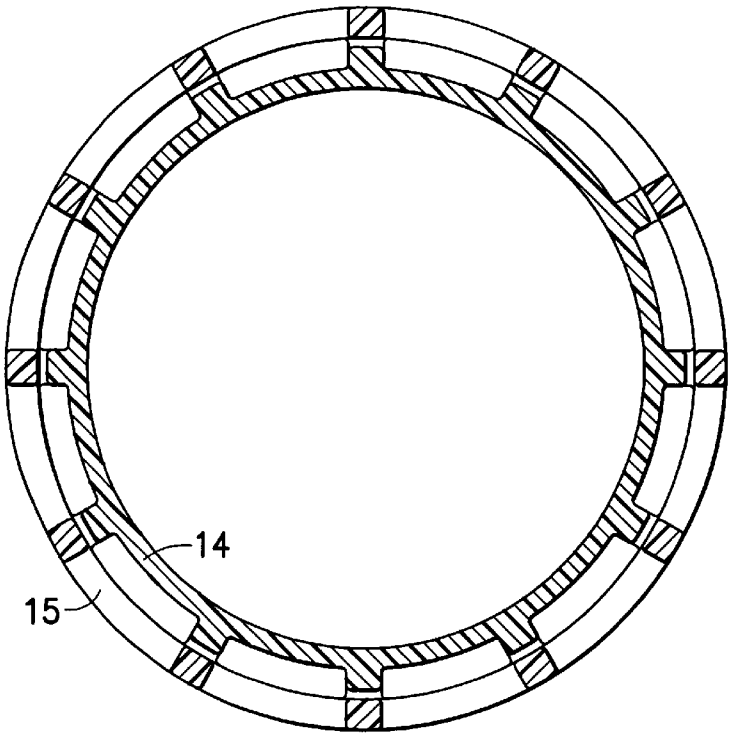
FIG. 9 is a sectional view of the teat cover and teat retaining cap taken along line "C" in FIG. 7.

The outer surface 51 of the cylindrical wall of the teat retaining cap 14 is provided with guide means in the form of a pair of projections 53*a*, 53*b* which are spaced so as to define a gap 58 therebetween. The projections 53*a*, 53*b* are located proximate the upper end 24 of retaining cap. As is best illustrated in FIG. 8, a series of pairs of projections 53*a*, 53*b* are located around the outer circumference of the cylindrical wall of the retaining cap.

The teat cover 15 is provided with a corresponding guide means on its inner surface 54. The guide means comprises a projection 55 located in the upper portion of the inside of the teat cover away from the open end 56 of the cover. In the embodiment depicted, the projection 55 extends in an axial direction down from the inside surface of the upper wall 57 of the cover. As is best illustrated in FIG. 8, a series of projections 55 are located around the inner circumference of the cover 15.

Upon fitting the teat cover 15 to the retaining cap 14 the projection 55 on the inner surface of the teat cover passes neatly through the gap 58 defined by the projections 53*a*, 53*b* on the outer wall of the retaining cap.

It should be appreciated that the inverse arrangement is possible, namely two projections defining a gap therebetween can be provided on the inside surface of the teat cover whilst a cooperating projection is provided on the outer surface of retaining cap. Alternatively, rather than using projections the same function could be achieved by providing appropriately located grooves in the outer surface of the teat cover and/or the inner surface of the retaining cap.

Cooperating locking means in the form of projections or lugs 60, 61 are provided on the outer surface of the retaining cap and the inner surface of the teat cover, respectively. The locking lug 61 is provided on the inside surface of the teat cover at a location proximate the open end 56 of the teat cover. The locking lug 60 is provided on the outside surface of the retaining cap at a location which will result in the two locking lugs 60, 61 cooperating to restrain the cap when the cap is fully fitted.

Referring to FIGS. 10*a*, 10*b*, and 10*c* the operation of one set of cooperating guiding and locking projections of the closure mechanism will now be described.

The projection 55 on the inside surface of the teat cover 15 is brought into alignment with the gap 58 between the two projections 53*a*, 53*b* on the outer surface of the retaining cap 14. When the projection 55 on the inside surface of the teat cover 15 is aligned with the gap 58 between the two projections on the outer surface of the retaining cap 14 the locking lug 61 on the teat cover and locking lug 60 on the retaining cap are also in proximity to each other. In this position the locking lugs 60, 61 are not in direct alignment but are slightly offset as illustrated in FIG. 10*a*.

To fit the teat cover to the retaining cap a force is applied which results in the relative downward movement of the teat cover over the retaining cap. As the teat cover moves downwardly over the retaining cap the respective outer surfaces 62, 63 of the locking lugs 60, 61 come into contact. The outer surfaces 62, 63 of the locking lugs have a plane of contact which is at an angle relative to the direction of the downward motion of the teat cover over the retaining cap. Further downward force results in the two surfaces 62, 63 of the locking lugs 60, 61 sliding over each other. This relative movement under the action of the downward force gives rise to a degree of distortion (torsion) in the lower end of the teat cover whilst the upper end of the teat cover is restrained from movement by the location of the projection 55 on the inner surface of teat cover between the projections 53*a*, 53*b* on the outer surface of the retaining cap.

Once the surface 63 of the locking lug 61 has passed over the surface 62 of locking lug 60 the torsional force on the teat cover is released and the locking lug 61 on the teat cover will snap back to a position beneath locking lug 60 on the container. When fitted, locking of the teat cover on the retaining cap is provided by the location of the lug 61 of the teat cover beneath the lug 60 on the retaining cap.

As can be seen from FIGS. 10*a*, 10*b*, 10*c* when the teat cover is fitted the application of a directly upward force will not remove the teat cover from the retaining cap. In order to remove the teat cover from the retaining cap it is necessary to apply a twisting (torsional) force in the region of the lower (open) end of the teat cover in order to move locking lug 61 laterally relative to locking lug 60 so as to clear the lower surface 64 of locking lug 60. Once clear, the application of an upward force will result in removal of the teat cover from the retaining cap.

As can be seen from the accompanying figures, the fastening arrangement for the teat cover on the retaining cap may comprise a plurality of such locking mechanisms spaced around the circumference of the opening of the retaining cap.

In a further alternative embodiment the relative location of the guide means and the locking means on both the teat cover and the retaining cap are inverted. That is, the locking means is located at the upper end of both the teat cover and the retaining cap, whilst the guide means are located at the lower (open) end of the teat cover and at a corresponding position on the retaining cap.

It should also be appreciated that the same fastening arrangement may be employed to connect the teat cover directly to the bottle rather than to the teat retaining cap.

It will be appreciated that various modifications to the size, shape, arrangement and material used in the nursing bottle and teat assemblies hereinabove described are possible without departing from the spirit and scope of the present invention and it is not intended that the invention be restricted to the preferred embodiments described.

What is claimed is:

1. An assembly comprising a nursing bottle, a teat, said teat having a flange with a sealing surface, and a retaining cap for releasably retaining the teat to the bottle;

wherein the retaining cap moves in a direction to act on the flange to press, the sealing surface of the flange into sealing engagement with a wall of the nursing bottle in a direction substantially parallel to the direction of movement of the retaining cap, to form a flap valve.

2. The assembly according to claim 1 wherein the flange of the teat has a resilient skirt dependent therefrom which provides the sealing surface of the flap valve.

3. The assembly according to claim 2, wherein stiffness of the skirt on the teat is selected to determine the minimum vacuum pressure at which the flap valve opens.

4. The assembly according to claim 1 wherein said retaining cap directly presses the sealing surface of the flap valve against the wall of the nursing bottle.

5. The assembly according to claim 1, wherein the retaining cap is releasably retained to the bottle by means of a bayonet coupling between the retaining cap and the bottle in which one or more fastening pins on the cap slide in a groove on the opposed surface of the bottle, said groove having an upper wall inclined towards the bottom of the bottle so as to increase the pressing force on the sealing surface of the flap valve as the cap is tightened.

6. The assembly according to claim 5, wherein said pressing force being adjustable so as to vary the minimum vacuum pressure at which the flap valve opens.

7. The assembly according to claim 1, wherein the retaining cap holds at least a portion of the flange between the bottle and the cap.

8. The assembly according to claim 1, wherein the wall of the nursing bottle has an externally facing surface, and the sealing surface of the flange presses against the externally facing surface.

9. The assembly according to claim 1, wherein an annular slip ring is located between a lower face of the cap and an upper face of the flange on the teat.

10. The assembly according to claim 9, wherein the slip ring comprises a suitable low friction material.

11. The assembly according to claim 10, wherein the low friction material is a low friction plastic.

12. The assembly according to claim 10, wherein the low friction material comprises PTFE.

13. The assembly according claim 1 which includes a teat cover which has a projection in the lower surface of its upper end, which, when fitted, presses against the top of the teat to seal the teat.

14. The assembly according to claim 13, wherein the teat cover is snap fitted to the retaining cap.

15. The assembly according to claim 14, wherein the teat cover is fastened by a snap fit action and removed by a turn and pull action.

16. The assembly according to claim 1, wherein the wall of the nursing bottle has an internally facing surface, and the sealing surface of the flange presses against the internally facing surface.

* * * * *